US010436544B1

(12) United States Patent
Jones

(10) Patent No.: US 10,436,544 B1
(45) Date of Patent: Oct. 8, 2019

(54) ARCHERY RELEASE

(71) Applicant: H.I.T. Outdoors, LLC, Clay City, KY (US)

(72) Inventor: Brian K. Jones, Georgetown, KY (US)

(73) Assignee: H.I.T. Outdoors, LLC, Clay City, KY (US)

( * ) Notice: Subject to any disclaimer, the term of this patent is extended or adjusted under 35 U.S.C. 154(b) by 0 days.

(21) Appl. No.: 16/156,534

(22) Filed: Oct. 10, 2018

(51) Int. Cl.
*F41B 5/18* (2006.01)
*F41B 5/14* (2006.01)

(52) U.S. Cl.
CPC ..... *F41B 5/1469* (2013.01)

(58) Field of Classification Search
CPC ..... F41B 5/1469
See application file for complete search history.

(56) References Cited

U.S. PATENT DOCUMENTS

| | | | |
|---|---|---|---|
| 228,302 | A | 6/1880 | Beard |
| 229,089 | A | 6/1880 | Burnham |
| 3,853,111 | A | 12/1974 | Stanislawski et al. |
| 3,965,884 | A | 6/1976 | Killian |
| 4,036,204 | A | 7/1977 | Scott |
| 4,041,926 | A | 8/1977 | Troncoso et al. |
| 4,160,437 | A | 7/1979 | Fletcher |
| 4,509,497 | A | 4/1985 | Garvison |
| 4,539,968 | A | 9/1985 | Garvison |
| 4,567,875 | A | 2/1986 | Fletcher |
| 4,574,767 | A | 3/1986 | Gazzara |
| 4,620,523 | A | 11/1986 | Peck |
| 4,674,469 | A | 6/1987 | Peck |
| 4,854,293 | A | 8/1989 | Roberts |
| 4,881,516 | A | 11/1989 | Peck |
| 5,009,214 | A | 4/1991 | Wilde |
| 5,025,772 | A | 6/1991 | Stevenson |
| 5,205,268 | A | 4/1993 | Savage |
| 5,261,581 | A | 11/1993 | Harden |
| 5,273,021 | A | 12/1993 | Tepper |
| 5,323,754 | A | 6/1994 | Pittman et al. |
| 5,448,983 | A | 9/1995 | Scott |
| 5,546,924 | A | 8/1996 | Todd |
| 5,595,167 | A | 1/1997 | Scott |

(Continued)

OTHER PUBLICATIONS

Various prior art releases (1) downloaded from http://www.archeryhistory.com/releases/releasespics/release.jpg on Dec. 29, 2009.

(Continued)

*Primary Examiner* — John A Ricci
(74) *Attorney, Agent, or Firm* — Warner Norcross + Judd, LLP

(57) ABSTRACT

An archery release is provided in the form of a back tension archery release having at least one of a micro adjustable moon pawl, a locking axle pin and/or a solid handle. The micro adjustable moon pawl can define detents or recesses. A fastener joined with an arm of the release can have an end that selectively engages a particular detent and prevents rotation of the pawl to thereby set a release point of the release. The locking axle pin can be an axle with first and second ends and a threaded intermediate portion that engages threaded holes in an arm of the release to secure the arms a fixed distance from one another, while the ends can allow the hood to freely rotate about them. The solid handle can extend between an archer's digits, and can be void of any internal holes therein.

20 Claims, 4 Drawing Sheets

(56) References Cited

U.S. PATENT DOCUMENTS

| | | | |
|---|---|---|---|
| 5,596,977 | A | 1/1997 | Scott |
| 5,685,286 | A | 11/1997 | Summers |
| 5,694,915 | A | 12/1997 | Summers |
| 5,765,536 | A | 6/1998 | Scott |
| 5,803,068 | A | 9/1998 | Summers |
| 5,850,825 | A | 12/1998 | Scott |
| 5,937,842 | A | 8/1999 | Summers et al. |
| 6,032,661 | A | 3/2000 | Goff et al. |
| 6,571,786 | B2 | 6/2003 | Summers et al. |
| 6,631,709 | B2 | 10/2003 | Carter et al. |
| 6,736,124 | B2 | 5/2004 | Carter |
| 6,895,951 | B2 | 5/2005 | Summers et al. |
| 6,945,241 | B2 | 9/2005 | Pellerite |
| 6,953,035 | B1 | 10/2005 | Summers et al. |
| 7,654,254 | B1 | 2/2010 | Rentz et al. |
| 8,622,051 | B2 | 1/2014 | Summers et al. |
| 2004/0079351 | A1 | 4/2004 | Summers et al. |
| 2009/0090342 | A1 | 4/2009 | Freitag et al. |
| 2009/0095270 | A1 | 4/2009 | Graves |
| 2010/0108047 | A1 | 5/2010 | Jones |
| 2011/0168146 | A1 | 7/2011 | Deceuster |
| 2012/0192844 | A1 | 8/2012 | Springer |
| 2012/0285431 | A1 | 11/2012 | Summers et al. |
| 2013/0025578 | A1 | 1/2013 | Jones |

OTHER PUBLICATIONS

Various prior art releases (2) downloaded from http://www.archeryhistory.com/releases/releasespics/release4.jpg on Dec. 29, 2009.

Prior art releases (3) downloaded from http://www.archeryhistory.com/releases on Jul. 21, 2011.

Prior art releases (4) downloaded from http://www.archeryhistory.com/releases on Jul. 21, 2011.

Longhorn Hunter (Jan. 2010).

ARCHERY RELEASE

BACKGROUND OF THE INVENTION

The present invention relates to an archery release aid, and more particularly to a back tension archery release.

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases are intended to consistently release the bowstring when the archer shoots the arrow, and thus increase the accuracy of the shot.

A common type of release used by some archers, and in particular competitive archers, is referred to as a back tension release. This release includes a release handle, a release head bracket pivotally joined with the handle and a hook pivotally secured to the release head bracket. The hook engages and holds the bowstring, and is configured to engage a pawl.

To operate the release so that it releases a bowstring held in the hook, an archer holds the handle, and concentrates to squeeze together their shoulder blades, or in other words, "tense their back." Because the archer holds the device in their hand, the movement of the back muscles while tensing their back moves the archer's hand, and in turn, rotates the release slightly. This slight rotation moves the release enough so that the hook disengages the pawl, and thereby becomes free to move and release the bowstring.

Back tension releases are highly effective at eliminating shot anticipation, which may hinder shot accuracy, because they release the bowstring somewhat unexpectedly. This typically improves shooting form and shot placement and thereby increases the accuracy of an archer using the back tension release.

Archers usually have preferences with regard to the amount of back movement necessary to actuate the release and thereby release the hook and bowstring held by that hook. Most back tension releases have a pawl secured to the handle upon which part of the hook moves. The pawl typically is held in a fixed orientation relative to the handle during a shot sequence, but can be selectively adjusted to alter its last point of engagement with the hook, thus changing the release point and sensitivity of the release relative to an archer's movement of their back muscles.

To adjust the pawl to an archer's particular preference, the archer manipulates a long screw that extends through the handle and abuts a sear surface of the pawl to hold it in place. The archer can loosen that long screw, which in turn disengages the sear surface of the pawl. The archer can then pivot the pawl about a pivot axis, which thereby moves the point of engagement with the hook. The archer can tighten the long screw again, carefully holding the pawl in place with their fingers, thereby fixing the pawl in a fixed orientation relative to the handle and setting the release point for the hook.

With conventional releases, the adjustment and movement of the pawl is rather random, as the pawl freely rotates about the pivot axis. Thus, the archer typically will loosen and tight screw multiple times, rotating the pawl accordingly until the release point is set perfectly for them. These multiple adjustments can be time consuming and tedious. Due to the random movement of the pawl, the adjustments also can be rather inconsistent and difficult to duplicate or monitor for the archer. The screw or handle also can become stripped with repeated overaggressive tightening.

In addition, the screw through the handle reduces the amount of material in the handle, thereby making the handle somewhat weak where the screw is located. This can lead to handle failure in some cases where the release is used to pull heavy poundage bows, or where the release undergoes a lot of abuse. In other cases, to prevent such failure, the handle cross section around the screw is increased so much that the handle in that location becomes too thick and fat to fit comfortably between a user's digits when the release used.

In some back tension releases, the function of the screw pressing against the pawl also holds an axle that is further joined with the hook. The screw does so by pressing that axle against the interior of a bore defined through the end of the arm of the handle. Thus, when the screw through the handle is loosed, that not only causes the moon to become rotatable and adjustable, it also relieves forces against the axle, in which case the axle can fall out of the end of the arm. When the screw is tightened, it holds the axle in place, but does not particularly hold the arm ends, which remain free relative to the axle, under heavy forces on the hook caused by drawing the bow with the release. Thus, those ends can separate under such forces, causing inconsistent rotation or binding of the hook when it disengages the pawl.

Accordingly, there remains room for improvement in connection with back tension releases and their components.

SUMMARY OF THE INVENTION

An archery release is provided in the form of a back tension archery release having at least one of a micro adjustable moon pawl, a locking axle pin and/or a solid handle.

In one embodiment, the archery release includes a micro adjustable moon pawl. The moon pawl can include multiple recesses or detents on one or both opposing side or lateral surfaces thereof. These recesses can be selectively engaged by one or more pins or fasteners that project through one or both ears on opposing sides of the moon pawl. The pins optionally can be in the form of fasteners. The fasteners can have ends that selectively engage the recesses and prevent rotation of the moon pawl relative to the axle.

In another embodiment, the recesses can be consistently spaced along the moon pawl side surfaces, and can follow an arcuate line or path. The one or more pins or fasteners can include a pointed tip that fits into selected corresponding recesses. An archer can selectively rotate the moon pawl to a suitable orientation, then engage a fastener in the corresponding recess to secure the moon pawl in a fixed, non-rotatable orientation relative to the ears and thus the handle, thereby setting a precise release point.

In still another embodiment, one or more recesses can be marked by the archer so that they can be selectively used in a repeatable manner, depending on an archer's preferences during a particular shooting event.

In yet another embodiment, the archery release can include a locking axle pin that is fixedly secured to first and second ears of the handle arm. The axle can be partially threaded, and can thread into corresponding threaded holes of one or both ears. The ends of the fastener can be rounded, without threads. The ends can protrude laterally from the ear or the arm. The hood can be rotatably mounted to these ends, and can freely pivot relative to the same.

In even another embodiment, the axle can be elongated and can include first and second ends, with an intermediate portion. The intermediate portion can be threaded, and the ends can be featureless, smooth and optionally cylindrical. The threaded portion can extend through and can be concealed by the moon and the ears. The ends can project from the surfaces of the opposing ears. The hood can mount to those projecting portions of the axle.

In still another embodiment, the archery release can include a release body having a handle, configured to engage an archer's digits, and an arm extending toward and joined with a release head, which can include a hood and a release hook. The arm can be configured to be placed between the archer's digits, and can connect the head and the remainder of the handle. Optionally, the handle can be substantially solid throughout, without any internal voids to accommodate moveable adjusters, such as screws.

A simple and efficient archery release is provided that enables an archer to precisely and consistently utilize the release according to the archer's physical stature and performance needs. When the micro-adjustable moon pawl is included, an archer can precisely and consistently adjust the release point of the release. With such a moon pawl, the archer also can identify preferred release points for different shooting scenarios and can consistently reset the moon pawl to those preferred release points. Where the locking axle pin is used to join the hood and hook with the handle, the axle itself can hold the ears of the handle together, preventing bowing or spreading of those ears over time or under significant forces generated during a draw cycle. Use of the axle also can eliminate the need for an extra screw through the arm of the handle which can enable that arm to be thinned substantially. When it is thinned, the arm naturally becomes more comfortable to fit between an archer's digits, yet still retains its strength.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

Figure 1:
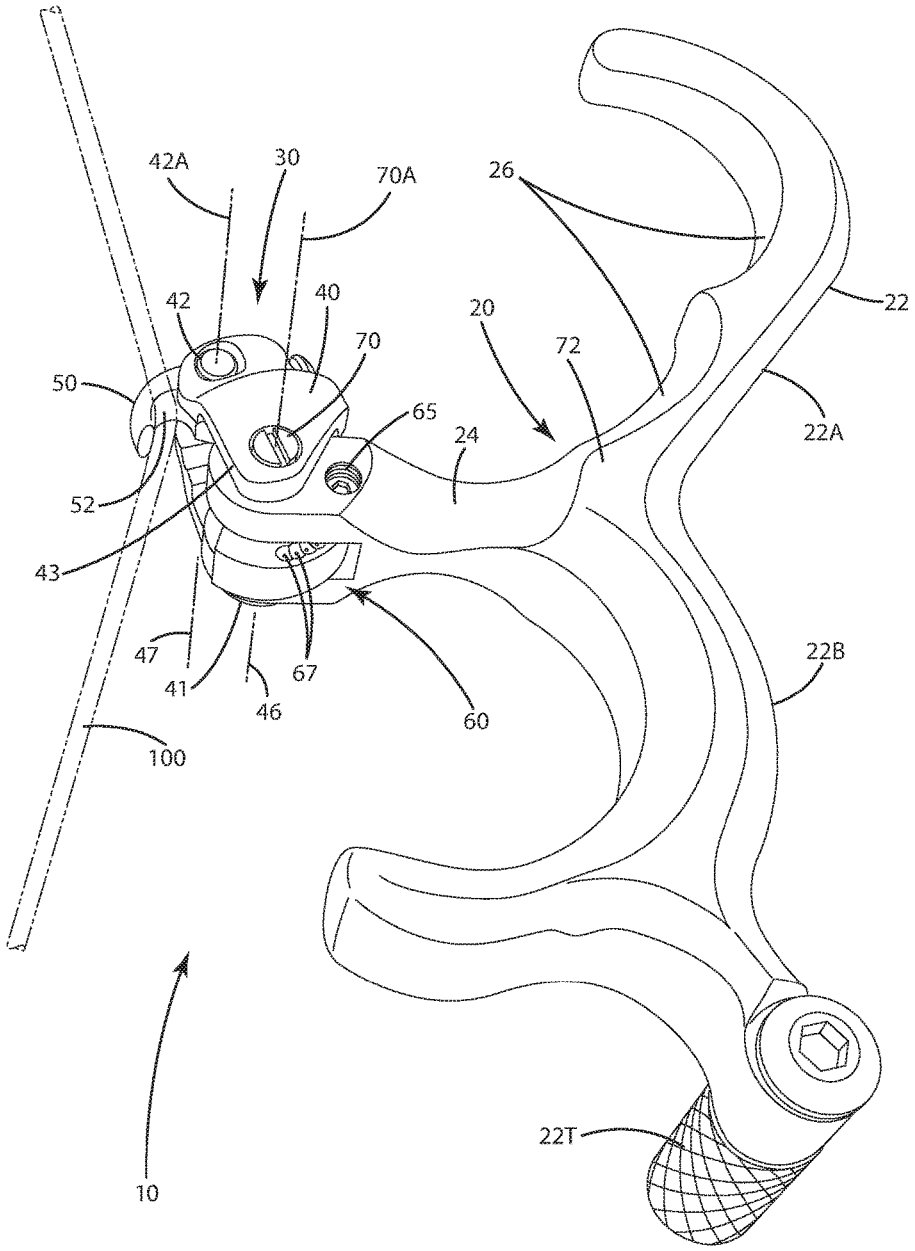
FIG. 1 is an upper perspective view of the archery release of a current embodiment engaged with a bowstring and held by an archer.

A current embodiment of the archery release is shown in FIGS. 1-4 and generally designated 10. The release 10 illustrated is in the form of a back tension release, however, the current embodiment can be utilized with a variety of different types of releases, for example, plunger releases, thumb releases, pinky releases, rope releases, and other types of handheld releases modified as described herein to be tethered to a wrist strap. The back tension release 10 shown in the figures includes a release body 20 joined with a release head 30, which can include a hood 40, a hook or sear 50 and a pawl 60.

The pawl can be a moon pawl 60 that can be micro adjustable to set a release point of the release. For example, the moon pawl 60 can define one or more detents or recesses 63, optionally around the axis 70A. One or more fasteners 65, 68 joined with an arm 24, or ears 24A and 24B of the arm, can have ends or tips that selectively engage particular ones of the corresponding recesses and prevent rotation of the pawl to thereby set a release point of the release. The release 10 can include a locking axle pin in the form of a first axle 70 with first 71 and second 72 ends and a threaded intermediate portion 73, which engages threaded holes 24AH and 24BH in ears 24A and 24B to hold the ears a fixed distance from one another, while the ends 71, 72 can allow the hood to freely rotate about them with the sear attached to the hood. The release 10 can include a solid handle portion, for example, the arm 24, which can extend between an archer's digits, and can be void of any internal holes therein that might promote weakness of the arm.

The release can be used to assist the archer in drawing and releasing the bowstring 101. When the release 10, as shown in FIG. 1, is used to draw the bowstring 100, the bowstring 100 is captured by the sear in a bowstring notch 52. As the archer draws the bowstring, the hook or sear 50 remains engaged the bowstring 100. After being drawn, the archer moves or rotates the handle to rotate about the axis 70A, which can be aligned with the first axle 70, in direction R by tensing the archer's back muscles, which translates to pulling on the first handle portion 22. When such movement occurs, the sear engagement edge 54 moves relative to the pawl engagement surface 66 until the sear engagement edge 54 disengages the same. Upon such a disengagement, the sear 50 is free to rotate, and thus release the bowstring 100 from the bowstring notch 52 of the sear, thereby shooting the bow with which the release is used.

As used herein, bowstring refers to an actual bowstring of an archery bow and any device or component adapted to join with a bowstring of an archery bow and aid an archer in drawing or releasing the bowstring, including rope loops, which are attached to the bowstring above and below the location where an arrow nock rests, and receivers, for example, a metal loop or partial loop that is joined with the bowstring above and below, or only above, or only below the location where the arrow nock rests on the bowstring.

As used herein archery bow refers to any compound bow, recurve bow, long bow, crossbow or any other device that propels or is capable of propelling an arrow, bolt or other similar projectile.

Referring to FIGS. 1-5 the components of the release 10 will now be described in detail. The release 10 can include a release body 20, which can include a handle 22. The handle can define multiple grooves or recesses 26 designed to accommodate one or more digits of a user. Alternatively, the handle can be a straight bar or other suitable gripping structure to enable a user to grasp the release body 20.

Figure 2:
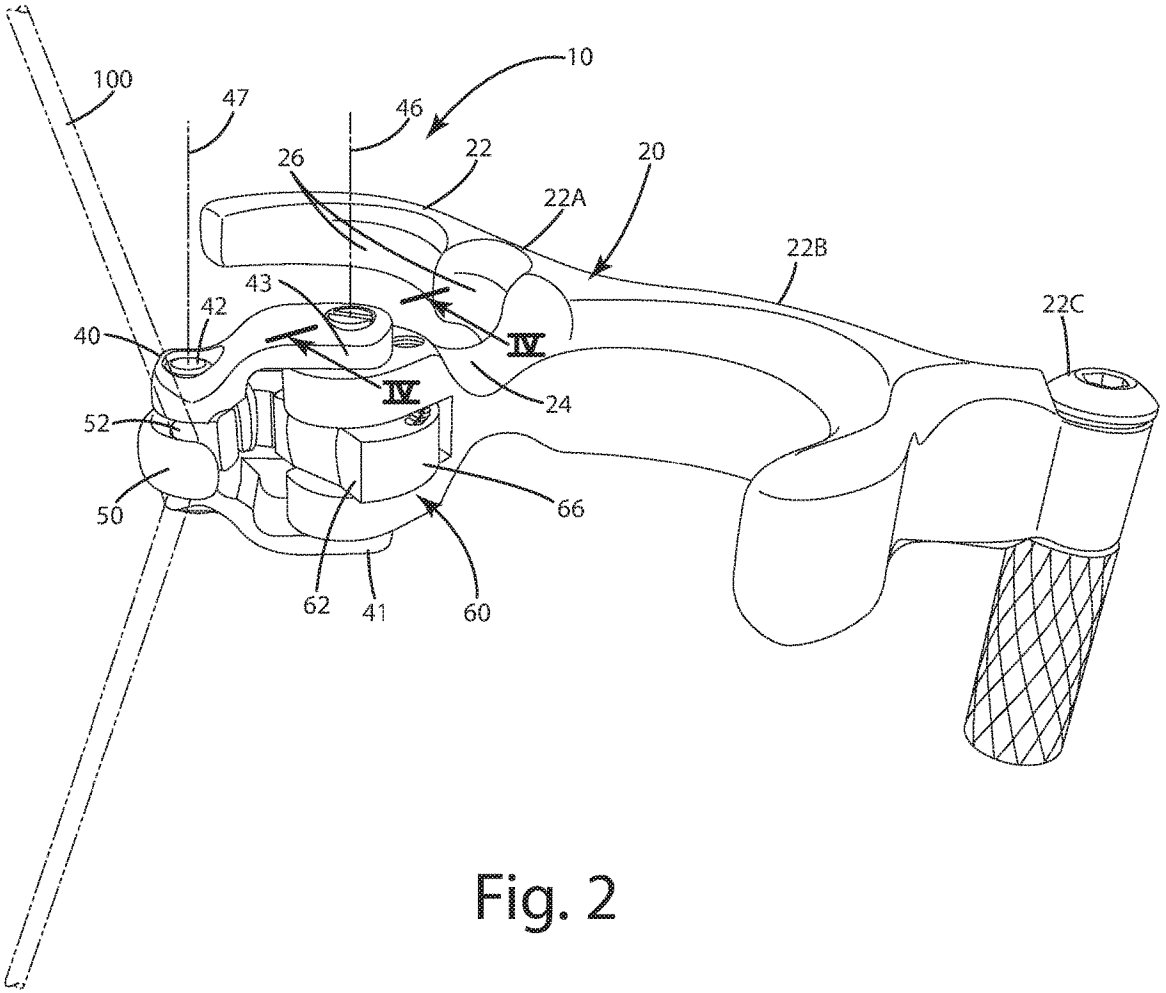
FIG. 2 is a perspective side view of the archery release engaging the bowstring.

As shown in FIGS. 1-2, an arm 24 can extend toward the release head 30 from the handle 22. The arm 24 can be an integral or separate from the handle 22 and remainder of the body 20. The handle 22 can include a first engagement portion 22A and a second engagement portion 22B. The first engagement portion 22A can be a first handle portion configured to engage certain digits on a user's hand, while the second engagement portion 22B can be a second handle portion configured to engage other digits on a user's hand. These first and second handle portions can extend on opposite sides of the arm 24, in opposite directions. With the arm so positioned relative to the first and second handle portions, the arm is configured to extend and fit between a user's digits when the handle is held in the user's hand. Optionally, the first handle portion 22A can extend to support other fingers, while the second handle portion 22B can wrap partially around and archers pointer finger when in use. Further optionally, the second handle portion 22B can include an extension 22C to which a thumb peg 22T is joined. This thumb peg can be held and/or actuated by an archer's thumb during a draw cycle.

Figure 4:
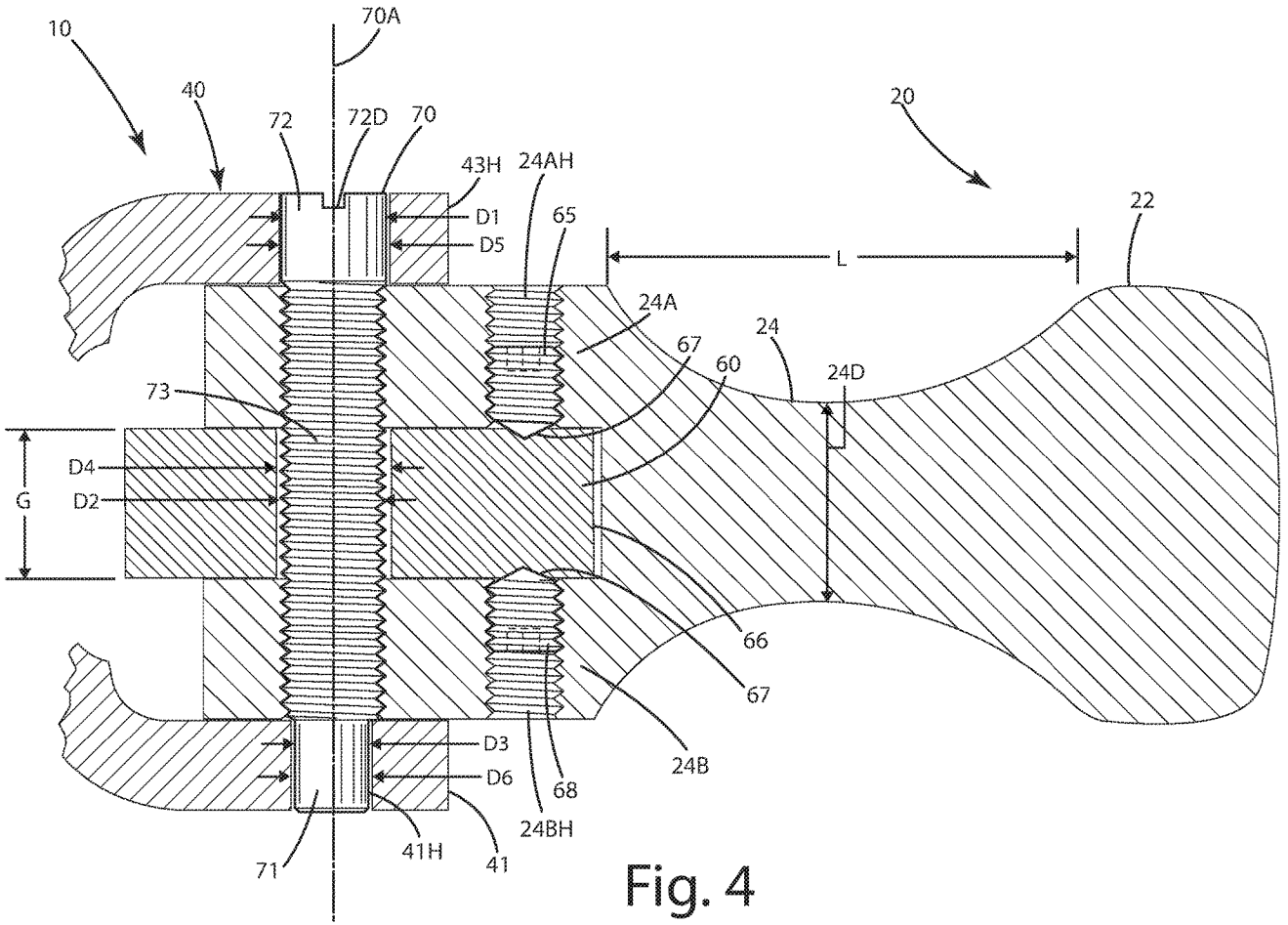
FIG. 4 is a section view of the moon pawl fasteners engaging the moon pawl, and the threaded axle engaging ears of a handle of the release.

The arm 24 can be constructed so that it is substantially solid and without any internal voids therein, as shown in FIG. 4. There, the cross-section of the arm is such that there are no holes, voids or internal compartments inside the exterior surfaces 24 of the arm. The arm 24 can include a length L and a thickness T transverse to the length. The length and thickness can be expressed in a ratio of length to thickness of optionally at least 2:1, further optionally at least 3:1, yet further optionally at least 4:1. Generally, the thickness can be such that the arm comfortably fits between adjacent fingers of an archer while the release is held.

The arm 24 can transition to a first ear 24A and a second ear 24B. These first and second ears can be separated by a gap G. The ears can extend outward away from the arm 24 and can themselves define holes, as described below, unlike the arm part which is configured to extend between digits of an archer's hand, and which does not include any internal voids or holes therein. The first ear 24A can define a first ear hole 24AH. The second ear 24B can define a second ear hole 24BH. Each of these ear holes can be threaded and configured to receive respective fasteners 65 and 68 therein. These fasteners can be set screws and themselves can be threaded to threadably engage the respective holes and the respective recesses 67 of the pawl 60 as described in detail below. Optionally, the set screws can be disposed in the holes so that no portion thereof extends outward from the exterior surfaces of the respective ears.

The ears as mentioned above can project outwardly and away from the remainder of the arm, and in particular the portion that is configured to fit between and archer's digits while the release is in use. The ears can be constructed to include specific surfaces. For example, the first ear 24A can include a first inner surface 24AI and a first outer surface 24AO. The second ear 24B can include a second inner surface 24BI and a second outer surface 24BO. The first ear 24A can be separated from the second ear 24B by the gap G. As described below, the moon pawl 60 can be disposed in the gap, with its first side surface 60A facing the first inner surface 24AI, and its second side surface 60B facing the second inner surface 24BI. When in this gap G, one or more of the multiple recesses 67 can be at least partially concealed by the first ear and/or the second ear, with those surfaces facing directly toward the respective inner surface of the respective ear.

Figure 3:
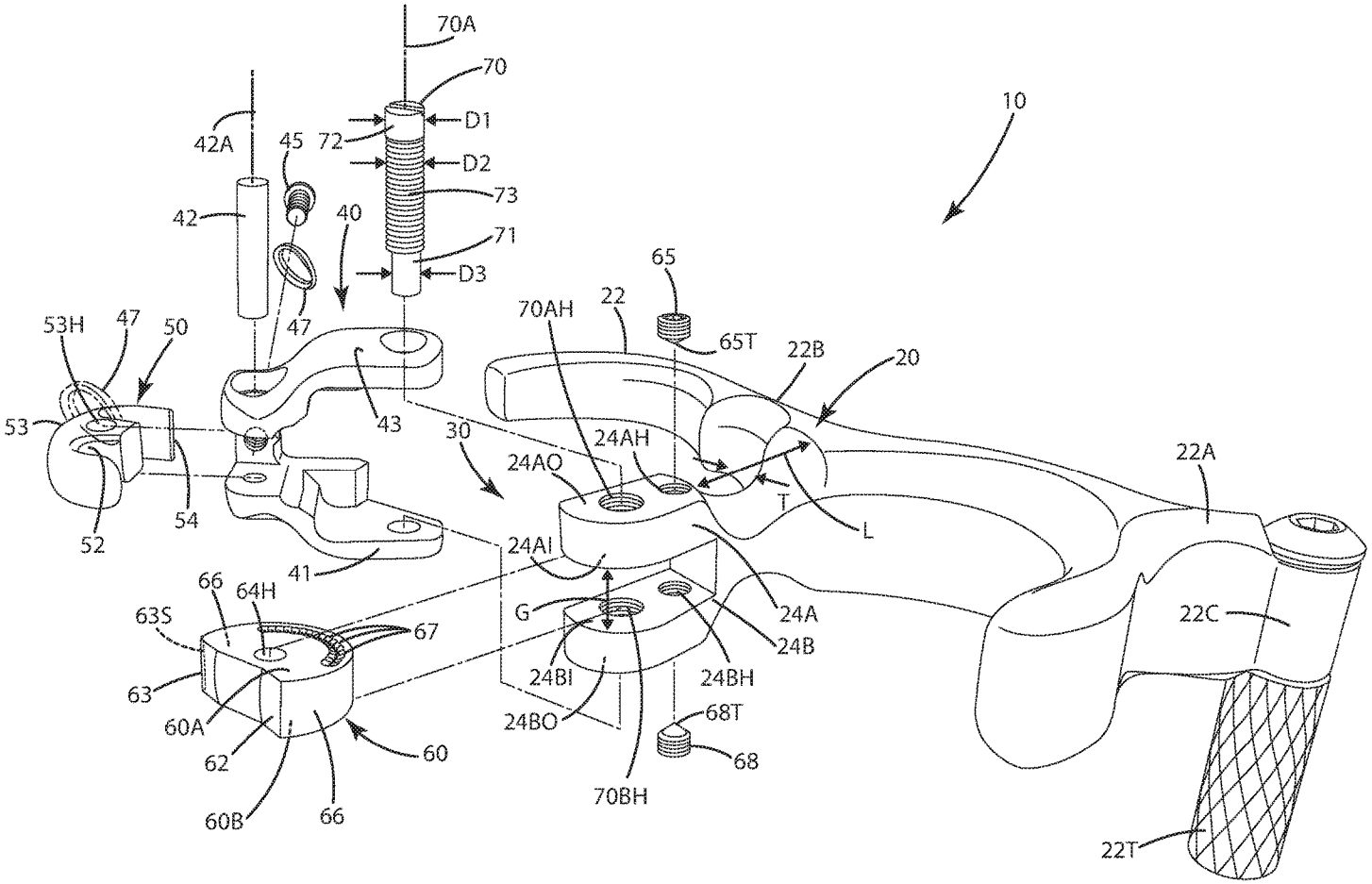
FIG. 3 is a perspective exploded side view of the archery release.

One or both of the first ear 24A and the second ear 24B can each define a threaded hole to receive a fastener that secures the moon pawl 60 in a predetermined fixed orientation relative to the arm and the remainder of the release to effectively fix a release set point. For example, as shown in FIGS. 3-4, the first ear 24A can define the threaded first hole 24AH which extends between the first inner surface and the first outer surface of the first ear. The second ear 24B can define a threaded second hole 24BH which extends between the second inner surface and the second outer surface of the second ear. Each of these holes can be substantially threaded, including threads therein. Each of these holes can be dimensioned to receive respective fasteners 65 and 68. These fasteners can be in the form of threaded elements, such as set screws, that interface with the threads of the respective first and second threaded holes. The fasteners 65 and 68 can be of respective length that enable a portion of the fastener to project from the first inner surface and second inner surface, but such that the heads of the fasteners do not project beyond the first outer surface and second outer surface of the respective ears. Each of the respective fasteners 65 and 68 can include a head with a drive element, such as a hexalobular or hexagonal keyhole within which a corresponding tool can fit. Of course, other drive features can be utilized with the fastener.

The opposing end of the respective fasteners 65 and 68 can include tips 65T and 68T. These tips can be pointed, for example they can be conical and/or frustoconical and configured to fit precisely in a respective recess of the multiple recesses 67 of the moon pawl 60. With this or fitment or engagement of the fasteners and their tips with respective selected ones of the recesses, the moon pawl can be rotationally restrained and set in a fixed orientation so that it will not rotate about the first axis 70A.

One or both of the first ear 24A and the second ear 24B can each define a threaded hole to receive an axle that secures the hood to the ears and arm in general, and that secures the moon pawl 60 to the arm and the remainder of the release. For example, the first ear 24A can define the threaded axle first hole 70AH which extends between the first inner surface and the first outer surface of the first ear. The second ear 24B can define a threaded axle second hole 70BH which extends between the second inner surface and the second outer surface of the second ear. Each of these holes can be substantially threaded, including threads therein. Each of these holes can be dimensioned to receive portions of the axle 70. In particular, the axle intermediate portion 73 can be threaded and can include threads that threadably engage the threads in the respective holes 70AH and 70BH. When these threads of the intermediate portion, which are near the first and 71 and second and 72 of the axle 70, engage the threads in the respective arms 24A and 24B, they can fix the width of the gap G and thus the distance between the first inner surface and the second inner surface of the respective first ear and second ear. With the intermediate portion of the axle 70 threadably engaging the first and second ears, that axle can hold those ears substantially parallel to one another, and the respective inner surfaces substantially parallel to one another, even when the axle is placed under substantial forces generated during the drawing of a bowstring with the release. Thus, the axle interfacing with the arms directly can impair and/or prevent those arms from bowing inwardly or outwardly under the forces during a draw cycle.

As shown in FIGS. 3 and 4, the release head 30 can include a hood 40. This hood 40 can be in the form of a channel-shaped member, including opposing sidewalls 41 and 43. These sidewalls can generally straddle an end of the release arm 24 and/or release body 20. The hood 40 can be secured via a first axle 70 to the arm or ears, and can freely rotate about the axle 70, for example, about a pawl axis 70A. At the opposite end of the hood 40, a sear axle or pin 42 can be located. A hook or sear 50 can be rotatably mounted to a sear axle or pin 42 so that the sear 50 can rotate about the sear axis 42A. The sear 50 itself can be spaced from the sidewalls 41 and 43 via spacers or some other elements so that the sear 50 aligns with the pawl 60.

As shown in FIGS. 3 and 4, the hood 40 can define a first hood hole 41H the second hood hole 43H, disposed on opposite sides of the hood, and configured to set and move adjacent the first outer surface and the second outer surface of the first and second arms respectively. The first hood hole 41H can be of a first dimension, such as a diameter, where the hole is cylindrical. This diameter D6 can be slightly greater than the dimension or diameter D3 of a tip or end 71 of the axle 70. Where the first end 71 of the axle is cylindrical, it can fit perfectly within the dimension D6 of the first hood hole 41H so that the hood can rotate about the first end. The second hood hole 43H can also have a dimension, such as a diameter, where the hole is cylindrical. This diameter D5 can be slightly greater than the dimension or diameter D1 of the head or and 72 of the axle 70. Where the second end 72 of the axle is cylindrical, it can fit perfectly within the dimension D5 of the second hood hole 43H so that the hood 40 can rotate about the second end of the axle freely. The first and second ends of the axle 70 can protrude laterally from the respective first ear and second ear of the arm. The respective portions 41 and 43 of the hood can be mounted to these protruding ends to rotatably mount the hood to the ears. Optionally, these first and second ends can be substantially cylindrical and threadless to promote rotation of the hood.

In some cases, the diameter D5 can be slightly greater than the dimension or diameter D1 of the head or second end 72 of the axle 70. Optionally, the diameter D1 of the second end or head can be equal to or greater than the diameter D3 of the first end or tip of the axle 70. Further optionally the diameter D3 of the first end 71 can be less than the diameter D2 of the intermediate threaded portion 73 of the axle. Yet further optionally, the diameter D1 of the second end or head 72 can be greater than the diameter D3 of the first end, and equal to the diameter D2 of the intermediate portion. Of course, these diameters can vary depending on the application.

Optionally, the second end 72 can include a drive feature 72D, which can enable the axle to be manipulated and turned with a tool to thread the intermediate portion into the threaded holes of the ears. This drive fastener can be a flat slot, a phillips hole, a hexalobular hole, a hexagonal key hole, or other type of drive feature.

Referring to FIGS. 1-2, the sear or hook 50 can be constructed to define a bowstring notch 52 which directly engages the bowstring of an archery bow. This bowstring notch 52 can transition to a sear body 53. The bowstring notch can include a curvilinear, planar or other smooth surface configured to minimize wear on a bowstring. The bowstring notch can be a U or V shaped opening or recess configured to capture at least a portion of the bowstring.

The sear body 53 can define a hole 53H through which the sear axle 42 fits so that the sear can rotate about the sear axis 42A. The sear axle 42 also can join the sear body 53 to the hood 40. The sear 50 can include a sear engagement edge 54 which can be in the form of a polished or extremely smooth and optionally planar surface that is adapted to selectively and slidably engage the pawl engagement surface 66, which itself can be polished or extremely smooth, and optionally curvilinear. If desired, the sear 50 can be selectively tensioned or biased to a preselected configuration with a rubber band or other biasing element 47 held by a pin or fastener 45.

The moon pawl 60 can be attached to the arm 24 and the release body 20 with the locking axle pin 70. As shown, in FIGS. 2-3, the moon pawl 60 is in the form of a partial moon pawl including a rounded or curvilinear pawl engagement surface 66 and a chordal planar surface 62. The pawl engagement surface 66 can extend between the first side surface 60A and the second side surface 60B. The curvilinear pawl engagement surface can be configured so that the sear engagement edge 54 moves and or slides along the curvilinear engagement surface during a portion of the draw cycle with the release. Optionally, the pawl can be in the form of a truncated or D-shaped disc. Further optionally, the pawl edge 63 can include a shoulder 63S between it and the pawl engagement surface 66 so that the sear edge drops into this shoulder after sliding along the curvilinear pawl engagement surface to produce an audible click right before the sear edge disengages the moon pawl to release the release.

The pawl 60 can be mounted to the arm 24 in a preselected configuration according to the preference and sensitivity of the release to the archer. Depending on the precise placement of the rounded surface and the chordal planar surface 62, the sear engagement edge 54 can engage and disengage the pawl engagement surface 66 at the pawl edge 63 thereby allowing the sear 50 to freely rotate about the sear axis 42A, and thereby release the bowstring 100 from the bowstring notch as described in further detail below.

The moon pawl 60 can be adjustable so that the precise degree of rotation of the chordal planar surface 62, and the precise location of the pawl edge 63, can be adjusted to effectively set the release point of the release, at which point, the sear disengages the pawl and releases the bowstring from the release. This can enable an archer to adjust the sensitivity of the release to their preference. Adjustability of the moon pawl 60 can be provided via the fasteners 65 and 68 engaging a respective ones of the multiple recesses 67 defined on the first 60A and second 60B side of the moon pawl 60. For example, to move the location of the sear engagement edge 63, and archer can loosen the first and second faster 65 and 68 so that they partially unthreaded from the respective holes 24AH and 24BH. The archer then rotates the moon pawl 60 within the gap G so that the first and second side surfaces 60A and 60B of the moon pawl slide and move relative to the first inner surface 24AI and for second inner surface 24BI. The moon pawl 60 also defines an internal bore 64H. This internal bore has a dimension D4 that is equal to or slightly greater than the dimension D2 of the intermediate threaded portion 73 of the axle 70. Thus, the pawl 60 rotates about the intermediate portion 73 of the axle, optionally without threadably engaging the 64H. As this occurs, the location of the sear engagement edge 63 changes relative to the release and effectively rotates about the axis 70A. The archer can rotate the moon pawl about that axis 70A a predetermined amount. When that amount is achieved, the archer can tighten the fasteners 65 and 68, bring them toward the plurality of recesses 67. Each of the fasteners 65 and 68 can engage a respective selected one of the plurality of recesses 67 on the respective first and second sides. When this occurs, the tips of the fasteners slightly enter into and/or engage the respective recesses as shown in FIG. 4. This in turn rotationally constrains and fixes the orientation of the moon pawl and the associated sear engagement edge relative to the remainder of the release, the handle and the release body. Thus the release point of the release can be so set.

As mentioned above, the moon pawl 60 includes the multiple recesses 67. As shown in FIG. 3, these recesses can be defined on the first side surface 60A and second side surface 60B of the moon pawl, generally facing toward the respective fasteners 65 and 68 of the ears. These recesses can be disposed along a curvilinear path that optionally can be centered about the axis 70A. The recesses can be spaced in small increments such that they do not overlap with one another and so that the sear engagement edge can be precisely placed. Of course, in other applications, each of the respective recesses can partially overlap one another. The recesses can be placed on the side surfaces such that they are closer to the curvilinear engagement surface 66 than they are to the axis 70A. The recesses can be placed closer to the curvilinear engagement surface 66 than they are to the bore 64H of the moon pawl 60. One or more of the recesses can optionally be marked by the archer so that the archer can consistently and accurately engage that recess with a fastener to set the moon pawl in a particular orientation. For example, the archer can mark with a color one or more recesses to indicate a particular release point associated with the recesses.

Optionally, as mentioned above, the moon pawl can define a threadless bore 64H. This threadless bore can be aligned with the first hole 70AH in the second hole 70BH of the first and second ears. The axle 70 can threadably engage the first hole and second hole, but optionally can extend through the threadless bore 64H also referred to as a moon pawl hole. Where the axle 70 extends through the threadless bore, that axle can be threaded in the intermediate threaded portion 73. This intermediate threaded portion however optionally does not threadably engage the bore or the moon pawl in general, so that the moon pawl can rotate relative thereto when it is being adjusted for the release set point.

The components of the release, for example, the handle, the release head and its parts can be constructed from a variety of materials, for example, metal, such as steel, stainless steel and aluminum, as well as other synthetic materials such as polymers, and any combination of the foregoing. Further, the release 10 and its components can be treated with special processes, for example, anodizing, dipping or filming to provide the release and its components with a desired finish and appearance. In general, components of the release, such as the release head, first adjuster and adjuster linking element can be molded, machined and/or extruded to obtain their desired configuration. These components can also be treated with special processes as described above to provide a desired finish.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientations.

The embodiments of the invention in which an exclusive property or privilege is claimed are defined as follows:

1. An archery release comprising:

a handle including an arm extending forward of a digit engagement portion of the handle;

a moon pawl joined with the arm, the moon pawl defining a plurality of recesses offset from an axis of the moon pawl, the moon pawl including a first side surface bounded by a curvilinear engagement surface that is generally perpendicular to the first side surface;

a sear including a bowstring notch and a sear edge, the sear edge adapted to slidably engage the moon pawl; and a fastener engaged with the arm and configured to selectively engage at least one of the recesses to fix an orientation of the moon pawl relative to the arm, wherein the arm includes an ear that extends adjacent the first side surface of the moon pawl, wherein the plurality of recesses are defined by the first side surface and are distal from the curvilinear engagement surface of the moon pawl;

wherein the fastener extends through the ear and toward the first side surface rather than toward the curvilinear surface, and whereby an archer can set the release point of the release by engaging the fastener with a selected at least one recess.

2. The archery release of claim 1, wherein the plurality of recesses are defined on the first side surface but not the curvilinear engagement surface.

3. The archery release of claim 2, wherein the sear includes a sear engagement edge configured to slide along the curvilinear engagement surface, wherein the plurality of recesses are closer to the curvilinear engagement surface than the axis of the moon pawl.

4. The archery release of claim 1, wherein the arm includes a first ear and a second ear separated from one another by a gap, wherein the first ear includes a first inner surface and a first outer surface, wherein the second ear includes a second inner surface and a second outer surface, wherein the moon pawl is disposed in the gap, wherein the first side surface faces the first inner surface of the first ear, wherein the second side surface faces the second inner surface of the second ear, wherein the plurality of recesses is at least partially concealed by the first ear.

5. An archery release comprising, a handle including an arm extending forward of a digit engagement portion of the handle;

a moon pawl joined with the arm, the moon pawl defining a plurality of recesses offset from an axis of the moon pawl;

a sear including a bowstring notch and a sear edge, the sear edge adapted to slidably engage the moon pawl;

a fastener engaged with the arm and configured to selectively engage at least one of the recesses to fix an orientation of the moon pawl relative to the arm, wherein the arm is substantially solid and without any internal voids therein, wherein the arm is configured to fit between adjacent ones of an archer's digits, whereby an archer can set the release point of the release by engaging the fastener with a selected at least one recess.

6. The archery release of claim 5, wherein the arm is joined with a first handle portion and a second handle portion of the handle extending on opposite sides of the arm.

7. An archery release comprising:

a handle including an arm extending forward of a digit engagement portion of the handle;

a moon pawl joined with the arm, the moon pawl defining a plurality of recesses offset from an axis of the moon pawl;

a sear including a bowstring notch and a sear edge, the sear edge adapted to slidably engage the moon pawl;

a fastener engaged with the arm and configured to selectively engage at least one of the recesses to fix an orientation of the moon pawl relative to the arm, wherein the arm includes a first ear including a first inner surface and a first outer surface, wherein the first ear defines a threaded first hole between the first inner surface and the first outer surface, wherein the moon pawl is disposed adjacent the first ear, wherein the moon pawl defines a threadless moon pawl hole aligned with the first hole, wherein the first side surface faces the first inner surface of the first ear, whereby an archer can set the release point of the release by engaging the fastener with a selected at least one recess.

8. An archery release comprising:

a handle including an arm extending forward of a digit engagement portion of the handle;

a moon pawl joined with the arm, the moon pawl defining a plurality of recesses offset from an axis of the moon pawl;

a sear including a bowstring notch and a sear edge, the sear edge adapted to slidably engage the moon pawl;

a fastener engaged with the arm and configured to selectively engage at least one of the recesses to fix an orientation of the moon pawl relative to the arm, an axle that includes a first end and a distal second end, with a threaded portion therebetween, wherein the axle threadably engages a threaded first hole defined by the arm, wherein the threaded portion extends through a threadless moon pawl hole defined by the moon pawl, whereby an archer can set the release point of the release by engaging the fastener with a selected at least one recess.

9. The archery release of claim 8, wherein the sear is rotatably mounted to a hood, wherein the hood is rotatably mounted to the first end on a first side of the hood, and rotatably mounted to the second end on a second side of the hood.

10. An archery release comprising:

a handle body including an arm extending forward of a digit engagement portion of the handle;

a pawl joined with the arm;

a hood joined with the arm via a first axle;

a sear including a bowstring notch and a sear edge, the sear edge adapted to slidably engage the pawl, the sear joined with the hood;

wherein the first axle includes a first end and a distal second end, with a threaded portion therebetween, wherein the threaded portion engages the arm, wherein the first and second ends engage the hood, allowing the hood to rotate.

11. The archery release of claim 10, wherein the sear is rotatably joined with the hood via a sear axle that is parallel to the first axle.

12. The archery release of claim 10, wherein the pawl is a moon pawl, wherein the pawl defines a pawl hole, wherein the threaded portion of the first axle extends through the pawl hole without threadably engaging the pawl hole.

13. The archery release of claim 10, wherein the hood defines a first hood hole and a second hood hole, wherein the first end is disposed in the first hood hole, wherein the second end is disposed in the second hood hole, wherein the threaded portion is disposed between the first and second hood holes.

14. The archery release of claim 10, wherein the arm defines a first arm hole that is threaded, wherein the threaded portion threadably engages the first arm hole, but not the hood.

15. The archery release of claim 10, wherein the arm defines a first arm hole that is threaded, wherein the threaded portion threadably engages the first arm hole, but not the pawl.

16. The archery release of claim 10, wherein the first end is substantially cylindrical and threadless, wherein the second end is substantially cylindrical and threadless, wherein the hood rotatably engages the first end and the second end, wherein the arm defines a first arm hole that is threaded, wherein the arm defines a second arm hole that is threaded, the first arm hole distal from the second arm hole, wherein the pawl is disposed between the first end and the second end, wherein the threaded portion threadably engages the first arm hole and the second arm hole, but not the pawl.

17. An archery release comprising:

a handle body including an arm;

a pawl joined with the arm;

a hood rotatably joined with the arm via a first axle; and a sear including a bowstring notch and a sear edge, the sear edge adapted to slidably engage the pawl, the sear joined with the hood;

wherein the first axle includes a first end and a distal second end;

wherein the first and second ends engage the hood, allowing the hood to rotate, wherein the arm is substantially solid and without any internal voids therein, wherein the arm is configured to fit between adjacent ones of an archer's digits.

18. The archery release of claim 17, wherein the arm is joined with a first handle portion and a second handle portion extending on opposite sides of the arm, away from the arm.

19. The archery release of claim 17, wherein the first axle includes a threaded portion between the first end and the distal second end, wherein the threaded portion threadably engages the arm without threadably engaging the pawl.

20. The archery release of claim 17 wherein the pawl is a moon pawl and defines a plurality of recesses, wherein a fastener is threadably engaged with the arm and configured to selectively engage at least one of the recesses to fix an orientation of the moon pawl relative to the arm, whereby an archer can set the release point of the release by engaging the fastener with a selected at least one recess.

* * * * *